US008800910B2

(12) United States Patent
Shepherd

(10) Patent No.: US 8,800,910 B2
(45) Date of Patent: Aug. 12, 2014

(54) ROLL-FORM TOILET WIPES AND DISPENSER

(76) Inventor: Ian Andrew Shepherd, Tarrytown, NY (US)

( * ) Notice: Subject to any disclaimer, the term of this patent is extended or adjusted under 35 U.S.C. 154(b) by 365 days.

(21) Appl. No.: 13/276,595

(22) Filed: Oct. 19, 2011

(65) Prior Publication Data

US 2012/0273543 A1 Nov. 1, 2012

Related U.S. Application Data

(60) Provisional application No. 61/480,056, filed on Apr. 28, 2011.

(51) Int. Cl.
*B65H 16/04* (2006.01)
*B65H 75/18* (2006.01)

(52) U.S. Cl.
USPC ..... 242/597.8; 242/601

(58) Field of Classification Search
CPC ..... A47K 2010/3266
USPC ..... 242/597.8, 597, 597.1, 597.4, 597.5, 242/601, 598.5, 598.6
See application file for complete search history.

(56) References Cited

U.S. PATENT DOCUMENTS

| | | | | | |
|---|---|---|---|---|---|
| 2,806,738 | A * | 9/1957 | Tsakalas | 239/52 |
| 3,258,216 | A * | 6/1966 | Wren | 242/564 |
| 4,089,481 | A * | 5/1978 | Ciuci | 242/564.4 |
| 5,454,500 | A * | 10/1995 | Chen | 225/46 |
| 5,598,987 | A * | 2/1997 | Wachowicz | 242/597.8 |
| 5,697,577 | A * | 12/1997 | Ogden | 242/598.6 |
| 5,833,169 | A * | 11/1998 | Morand | 242/560 |
| 5,971,138 | A * | 10/1999 | Soughan | 206/210 |
| 6,056,235 | A * | 5/2000 | Brozinsky | 242/598.6 |
| 6,146,365 | A * | 11/2000 | Nguyen | 604/292 |
| 6,382,552 | B1 * | 5/2002 | Paul et al. | 242/595 |
| 6,536,707 | B2 * | 3/2003 | Adelakun | 242/598.6 |
| 6,959,891 | B2 * | 11/2005 | Kapiloff et al. | 242/597.8 |

* cited by examiner

*Primary Examiner* — Emmanuel M Marcelo
*Assistant Examiner* — Justin Stefanon
(74) *Attorney, Agent, or Firm* — Shumaker, Loop & Kendrick, LLP

(57) ABSTRACT

A roll form toilet wipes dispenser including a housing defining an interior cavity, one open side, and an opening about a front of the housing, a side panel removably received within the open side of the housing and carrying a mandrel thereon, and an openable front cover connected to the housing adjacent the opening on the front of the housing, the front cover and the front opening cooperatively defining a discharge slot for withdrawing the wipes, the front cover having a protrusion extending therefrom in a direction of the housing and protruding through the discharge slot for engaging the wipes to assist in separating the sheets.

17 Claims, 10 Drawing Sheets

ROLL-FORM TOILET WIPES AND DISPENSER

CROSS-REFERENCE TO RELATED APPLICATION

This application claims priority to U.S. Provisional Patent Application Ser. No. 61/480,056 filed Apr. 28, 2011, the contents of which are incorporated by reference herein.

TECHNICAL FIELD AND BACKGROUND OF. THE INVENTION

1. Field of the Invention

The present invention relates generally to the field of toilet wipes and dispensers for dispensing the same, and more particularly, to roll form flushable toilet wipes configured to tear into sheets of a predetermined length upon withdrawal from a dispenser, and a dispenser configured to house the roll form toilet wipes rotatably therein and cooperate in tearing the roll into sheets upon withdrawal of the wipes from the dispenser.

2. Background of the Invention

Toilet paper is well known in the art for personal cleaning after the use of the toilet and for cleaning the toilet between uses. Toilet paper is typically found in either roll form configured to be torn into sheets at the time of use, or as individual sheets packaged flat within a container. While roll form toilet paper is typically dry, individual sheets are often moist and include one or more of a sanitizing agent and a moisturizing agent. Individual sheet type toilet paper is often referred to as "toilet wipes."

Roll form toilet paper, while economical and suitable for use with a dispenser having a simple design, is dry and thus does not provide adequate personal cleaning and/or sanitizing. Further, because some toilet paper tears into sheets more easily than others, and because conventional dispensers do not include means for constraining the rotation of the roll, users often use significantly more paper than needed, resulting in waste and cost. Still further, even in the event that roll form toilet paper was moist, existing roll form dispensers are not configured to retain the moisture, and paper loaded on existing dispensers would quickly dry out over time.

As for toilet wipes packaged flat within a container, the individual nature of the sheets requires them to be partially overlapped or folded together in the packaging such that the withdrawal of the top sheet pulls the underlying sheet along therewith into position for subsequent withdrawal. Individual sheet type wipes also require their own disposable package to retain the moisture, which disadvantageously requires a shelf or other horizontal surface in the area of the toilet for storage and access, wastes the packaging when the wipes are used up, and requires a variety of package designs to meet customer preference.

Accordingly, what is desired are toilet wipes provided in roll form configured for use with a reusable roll form type dispenser, and a dispenser configured to retain the moisture of the roll form toilet wipes.

BRIEF SUMMARY OF THE INVENTION

To achieve the foregoing and overcome the disadvantages of prior art toilet wipes and dispensers, embodiments of a roll form flushable toilet wipe and associated dispenser for dispensing the same are provided herein.

In one aspect, the roll form toilet wipes are moist and are configured to be torn into sheets with assistance from the dispenser.

In another aspect, the roll form toilet wipes include a continuous length of wipe divided into individual sheets.

In another aspect, the sheets are divided by perforations, slits or thinning along the width of the wipe.

In another aspect, the wipes engage a feature on the dispenser when withdrawn to assist in separating the sheets.

In another aspect, each sheet includes a slot coextensive with the division between sheets that is engaged by a feature of the dispenser.

In another aspect, the slot adjacent the division between sheets is defined by slits through the wipe.

In another aspect, the feature on the dispenser for separating the sheets protrudes through the wipe.

In another aspect, the roll form toilet wipes are moist with at least one of a sanitizing, moisturizing, antibacterial or antiviral agent.

In another aspect, the dispenser is reusable, wall-mounted and configured to house roll form toilet wipes therein in a rotatable manner.

In another aspect, the dispenser is substantially sealed to retain the moisture of the roll form toilet wipes.

In another aspect, the dispenser is side loaded and includes a mandrel that may be affixed to the housing or to the removable cover.

In another aspect, the dispenser includes a thin, elongate widthwise slot at the front of the dispenser through which the wipes are withdrawn.

In another aspect, the slot is defined by the housing and a hinged cover.

In another aspect, the dispenser includes a protrusion on the hinged cover that protrudes into the slot for engaging the wipes as the wipes are withdrawn to assist in separating the sheets.

In another aspect, the protrusion engages the area on the wipes adjacent the division between the sheets.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION OF THE INVENTION

Figure 1:
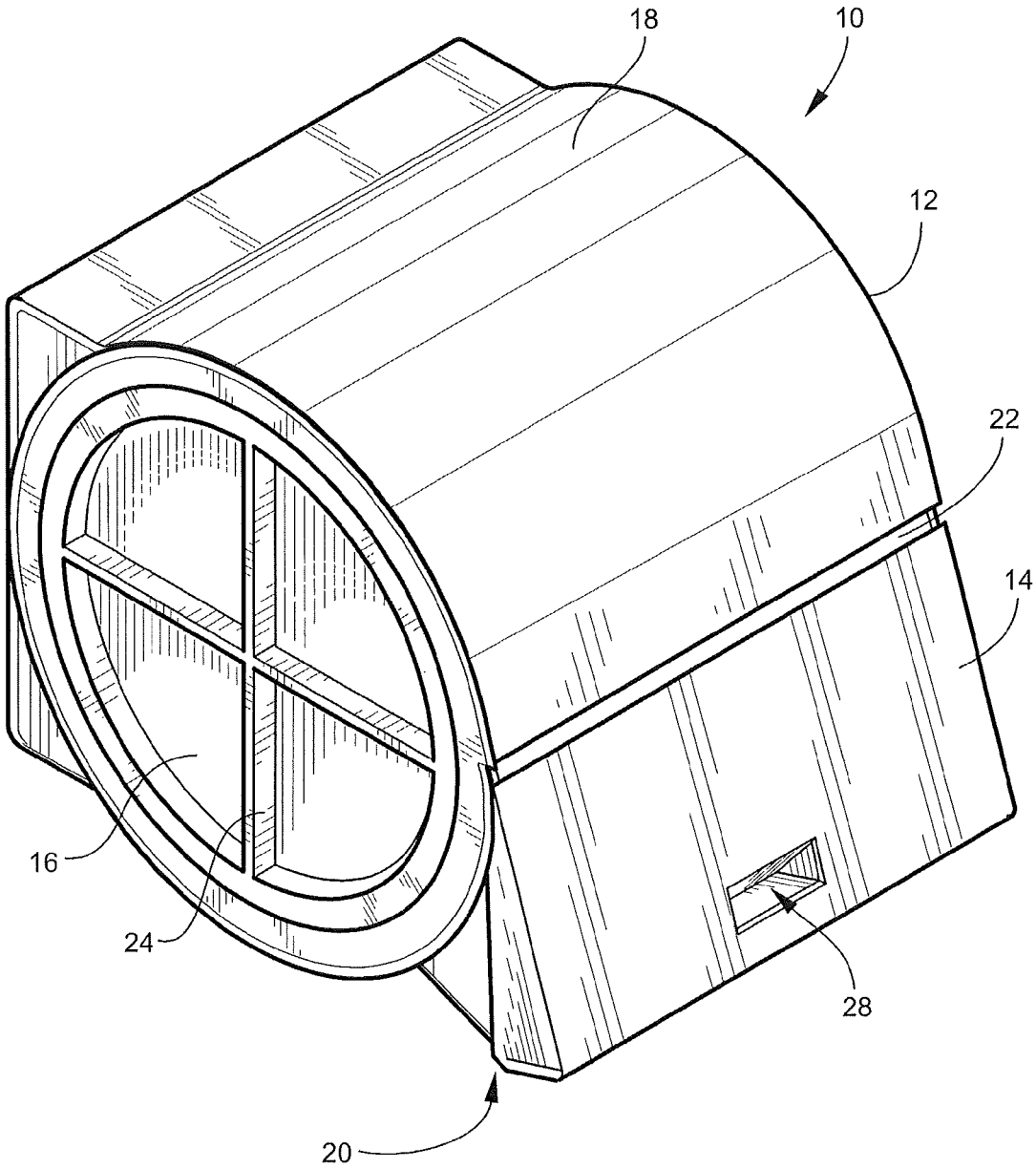
FIG. 1 is a front and left side perspective view of a dispenser according to one embodiment of the invention.

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Referring to the drawings, exemplary embodiments of a roll form toilet wipe and associated dispenser are provided. The dispenser as shown is generally configured to be mounted to a supporting surface, such as a vertical wall, using any conventional fastener. The dispenser may be constructed from any material, for example metal, polyethylene, polypropylene and other plastics. Although a specific dispenser shape is shown, it is envisioned that the dispenser may have alternative shapes while achieving the same functionality. Separable components of the dispenser, for example the removable side portion and hinged cover, may sealingly engage the housing to substantially seal the housing against moisture loss. The level of sealing may be adjusted based upon the application, installation environment and properties of the associated roll form toilet wipe.

Referring specifically to FIGS. 1-8, the toilet wipes roll dispenser is shown generally at reference numeral 10. The dispenser 10 generally includes a housing 12, a hinged front cover 14, and a removable side panel 16. The housing 12 has a shape generally corresponding to the size and shape of a conventional roll of toilet paper. As shown, a portion of the housing 12 extends rearwardly beyond a cylindrical portion 18 and provides structure clear of the rotation of the roll for securing the housing 12 to a supporting structure. Another portion of the housing 12 extends forwardly beyond the cylindrical portion and, together with the hinged front cover 14, defines a widthwise, thin, elongate discharge slot 20 through which the wipes are withdrawn.

The front cover 14 is hinged along its upper edge such that the front cover 14 can be raised or "opened," exposing the entire length of the slot 20 and providing access to the interior roll, such as in the event of a snag. A portion of the front cover 14 can overlap the housing 12 and may engage the housing 12 by interference fit and/or sealing engagement. The hinge 22 may be a living hinge, such as a thin flexible hinge made from plastic that joins the rigid front cover 14 and the housing 12 together while allowing them to bend along the line of the hinge 22. The hinge may be manufactured by an injection molding process that creates the housing 12, front cover 14 and hinge 22 at one time as a single part, and remains functional over the life of the dispenser 10. Suitable material choices for the housing 12, front cover 14 and the hinge 22 can include, but are not limited to, polyethylene and polypropylene, due to their excellent resistance to fatigue. It is envisioned that alternative hinge types may be used to interconnect the housing 12 and the front cover 14.

Figure 9:
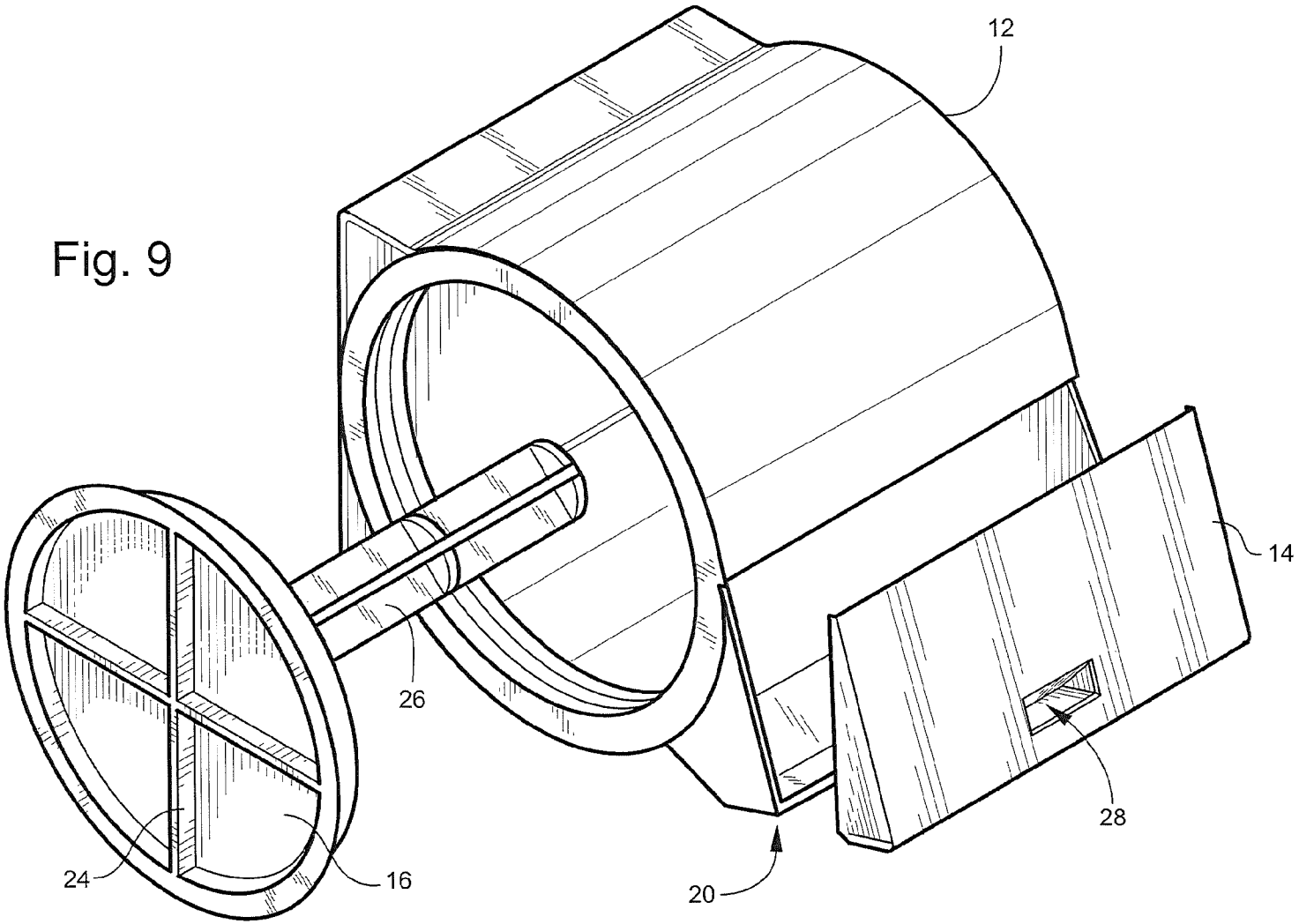
FIG. 9 is an exploded perspective view of the dispenser of FIG. 1.

The removable side panel 16 is generally disc-shaped and includes finger-graspable features 24 on the outside face for turning the side panel 16 by hand. The side panel 16 may engage the housing 12 by interference fit, or may be externally threaded and configured to engage an internally threaded housing 12 as shown. The side panel 16 has an external diameter generally corresponding to, and preferably sized slightly larger than, the external diameter of a full roll of toilet wipes. The side panel 16 is removed from the housing 12 to remove the empty roll and reload a full roll. The internal mandrel 26, which rotatably supports the roll of toilet wipes thereon, may be attached to the inner wall of the housing on the side opposing the side panel 16, or may be attached to the interior wall of the side panel 16, for example concentrically aligned on the side panel 16 as shown in FIG. 9. The mandrel 26 may or may not rotate relative to the side panel 16 and/or the housing 12.

Figure 2:
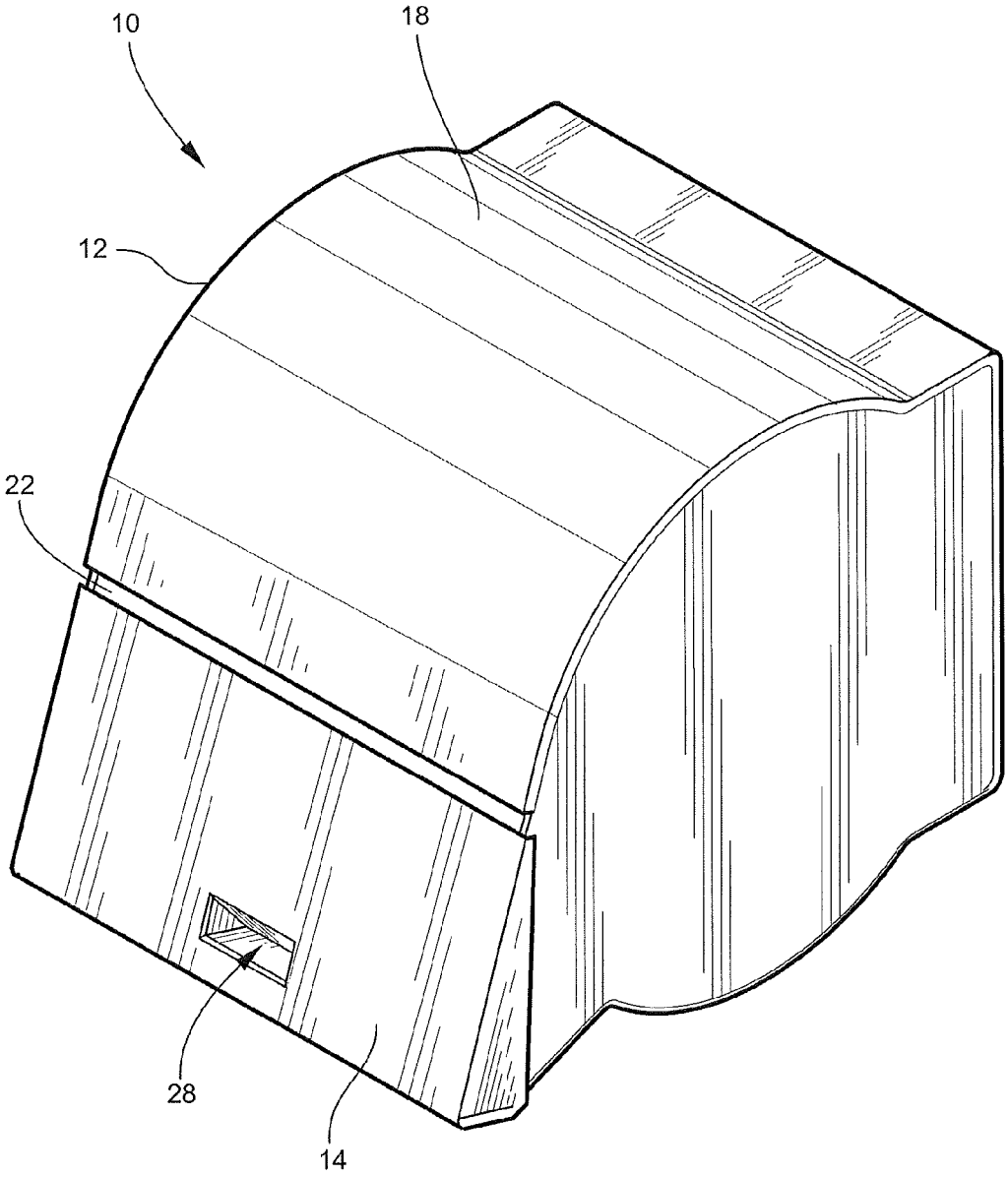
FIG. 2 is a front and right side perspective view of the dispenser of FIG. 1.
Figure 3:
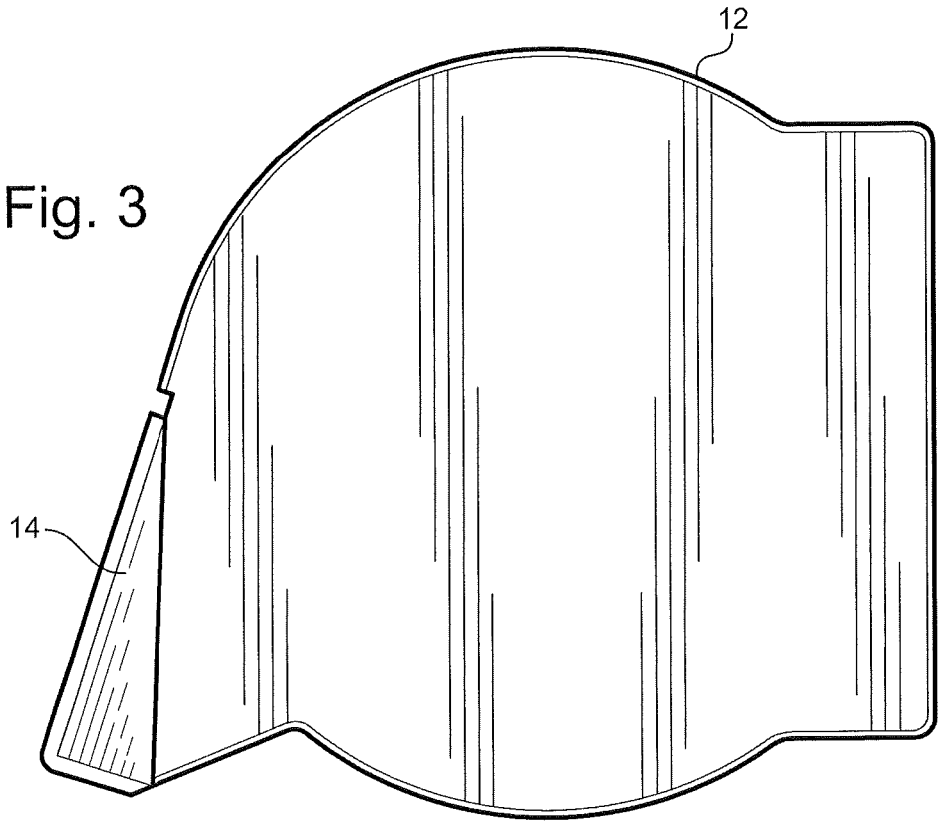
FIG. 3 is a right side elevation view of the dispenser of FIG. 1.
Figure 4:
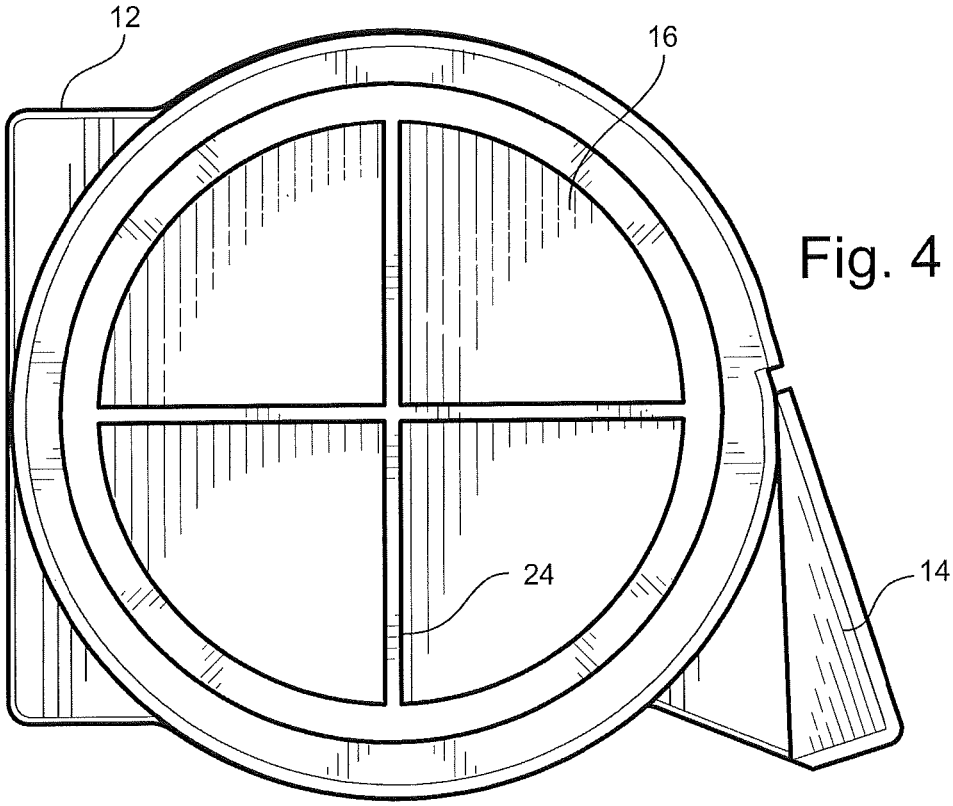
FIG. 4 is a left side elevation view of the dispenser of FIG. 1.
Figure 5:
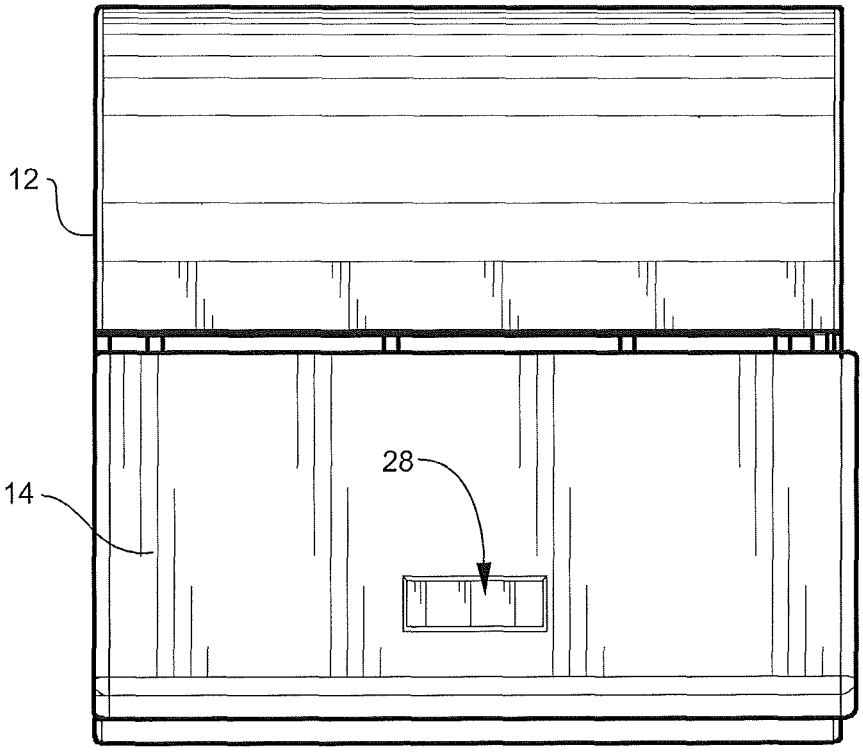
FIG. 5 front elevation view of the dispenser of FIG. 1.
Figure 6:
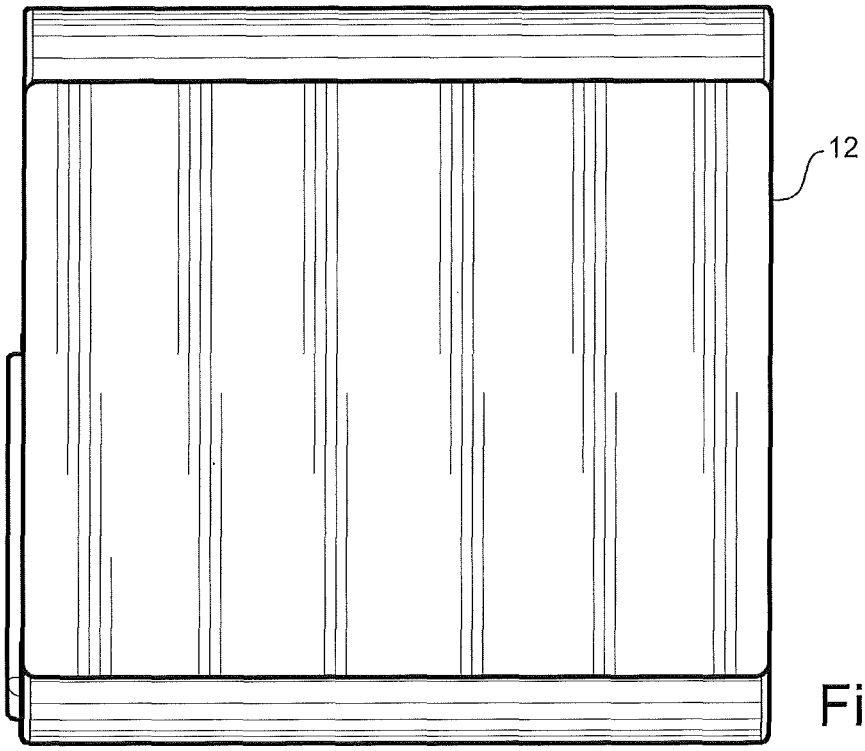
FIG. 6 is a back elevation view of the dispenser of FIG. 1.
Figure 7:
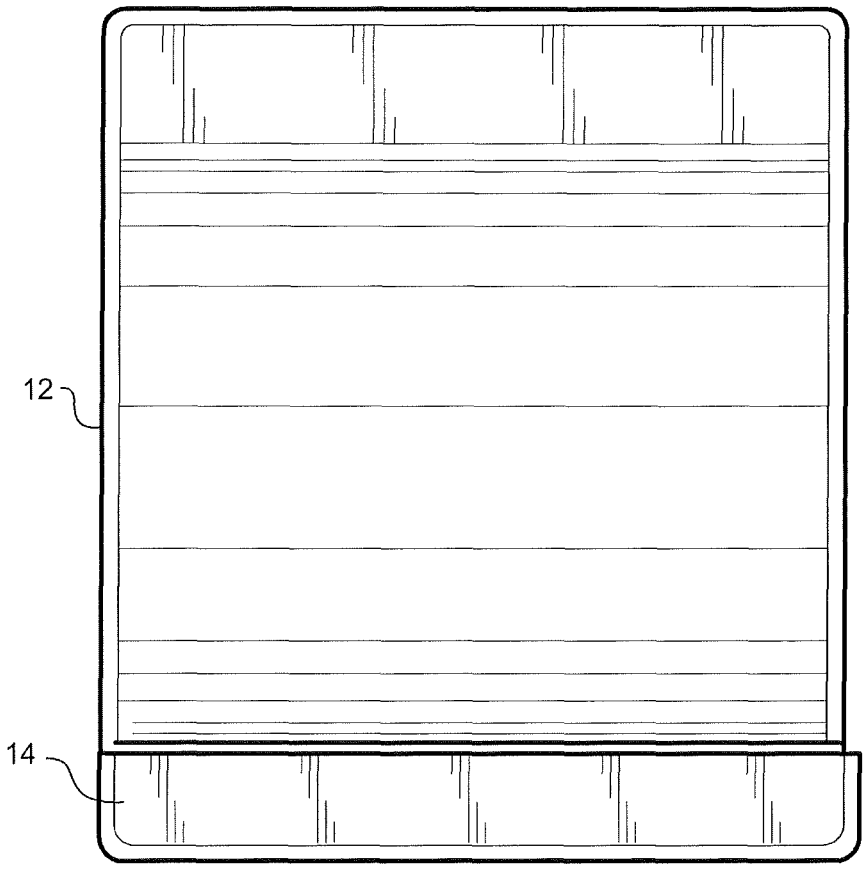
FIG. 7 is a top plan view of the dispenser of FIG. 1.
Figure 8:
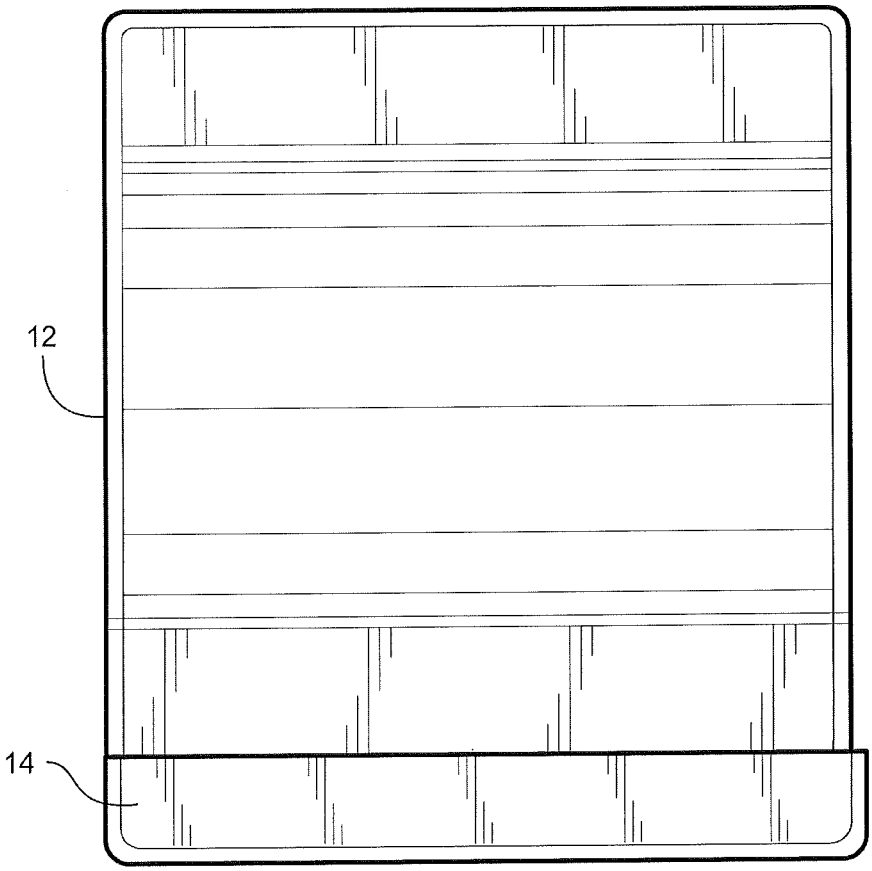
FIG. 8 is a bottom plan view of the dispenser of FIG. 1.
Figure 11:
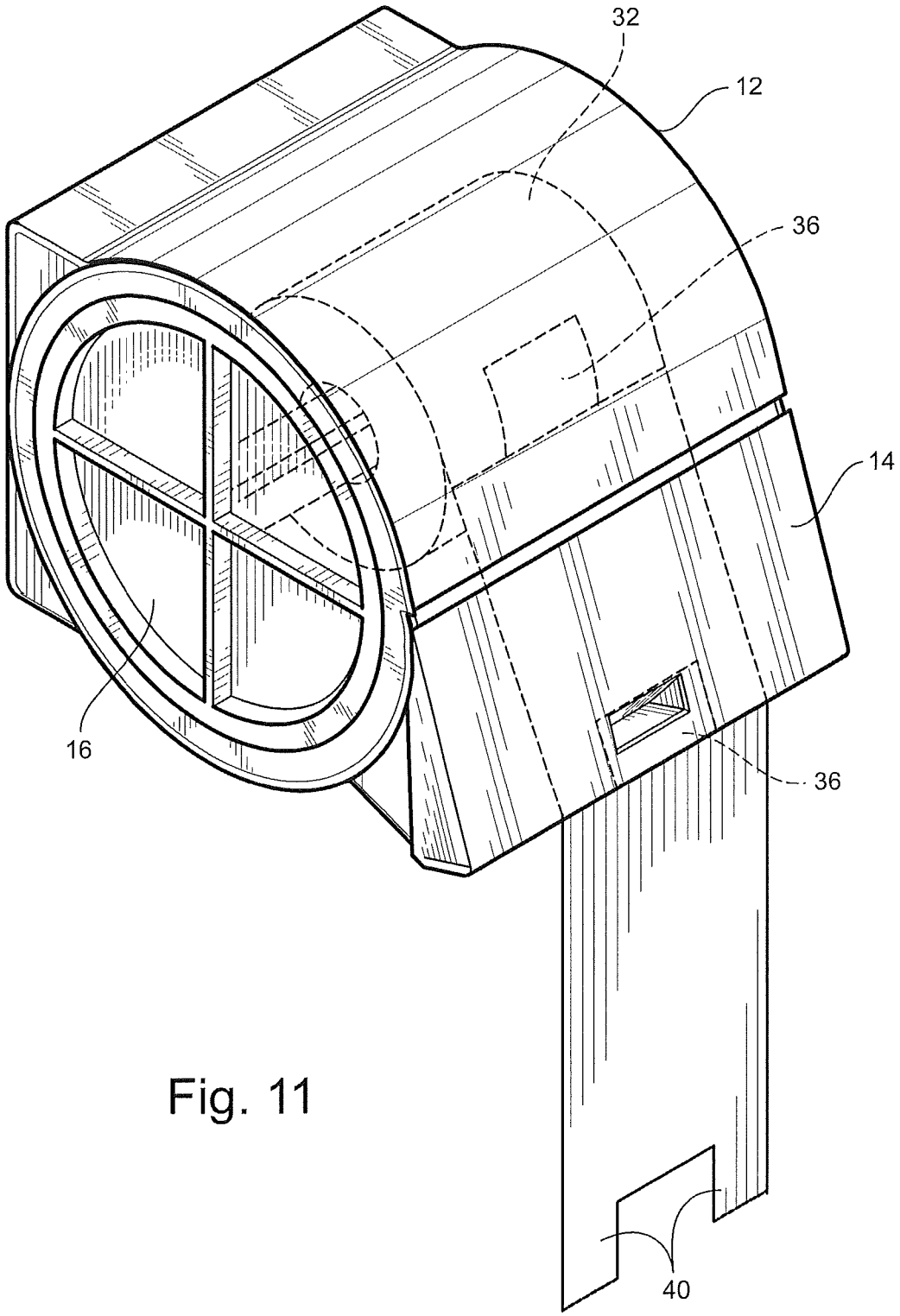
FIG. 11 is a perspective view showing the toilet wipes roll installed within the dispenser.
Figure 12:
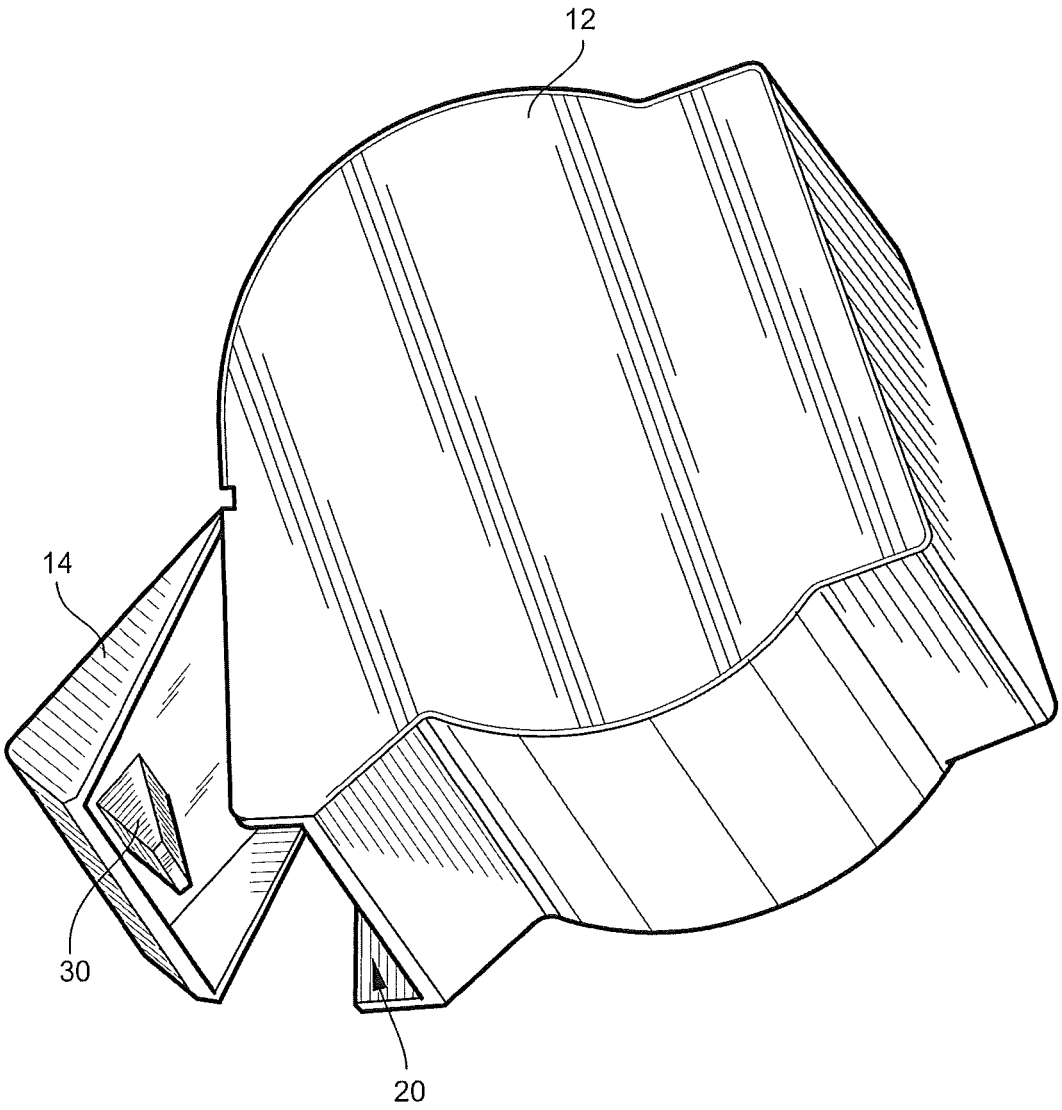
FIG. 12 is a perspective view of the dispenser of FIG. 1 shown the front cover is the open position to illustrate the toilet wipes roll engaging feature.

A protrusion 30 extends from the inner major face of the front cover 14 in the direction of the housing 12. As described in detail below, the protrusion 30 extends into the slot 20 and contacts the continuous wipe to assist in separating the wipe into sheets. Referring specifically to FIGS. 1, 2 and 11, the protrusion 30 is molded into the front cover 24 and defines a recess 28 in the outer major face of the front cover 14 that can serve as a handle for assisting in opening and closing the front cover 14.

Figure 10:
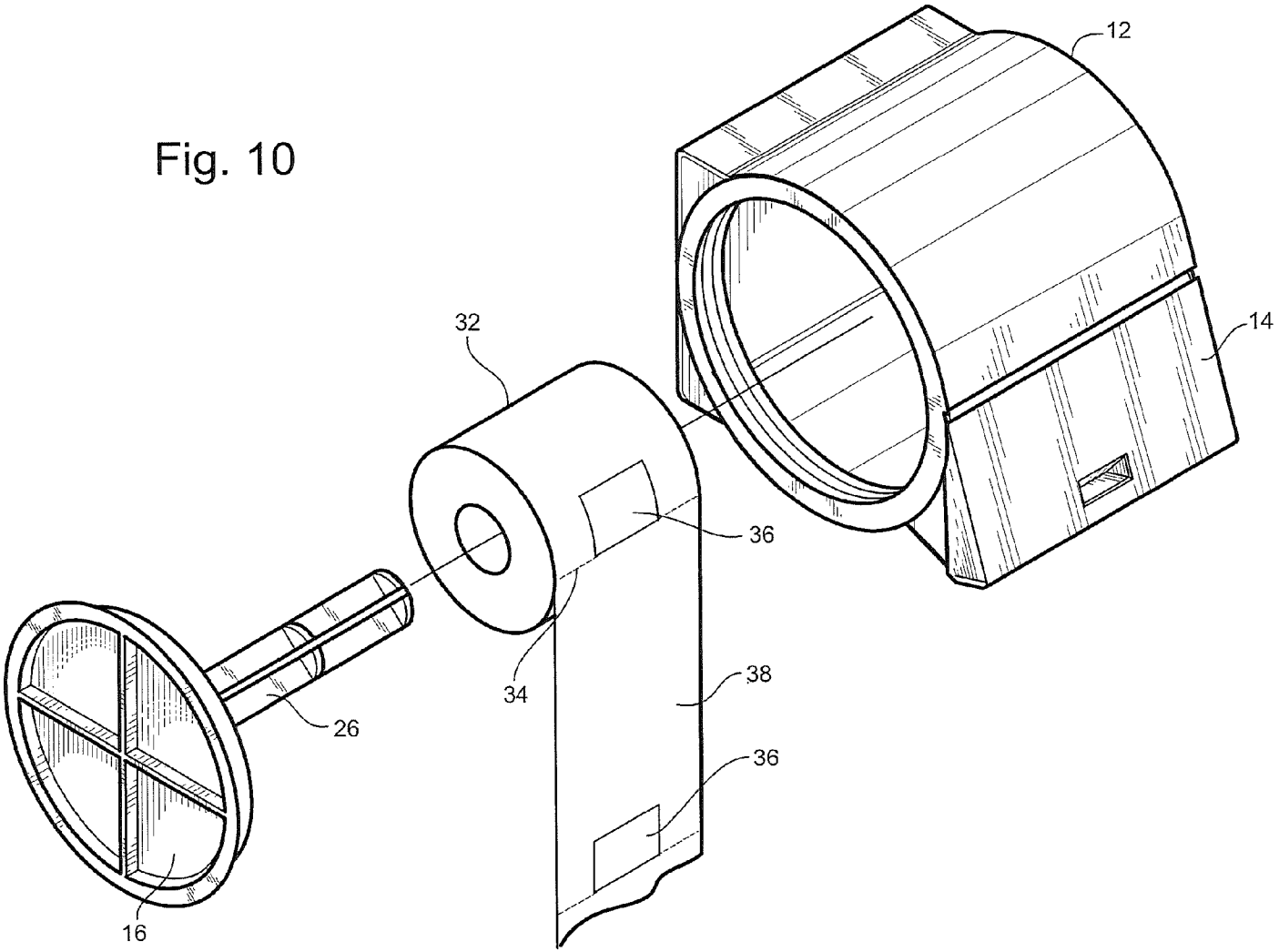
FIG. 10 is an exploded perspective view of the dispenser of FIG. 1 including a toilet wipes roll according to one embodiment of the invention.

Referring specifically to FIG. 10, a roll form or toilet wipes is shown generally at reference numeral 32. The roll 32 includes a continuous length of wipe divided into a plurality of sheets 38 separated by a perforation, slit, thinning or other engineered weakness at predetermined intervals along the width of the wipe shown generally at reference numeral 34. The roll 32 further a slot 36 adjacent the division between each sheet 38 that contacts, engages with or "snags" on protrusion 30 as the wipe is withdrawn through the slot 20 of the dispenser 10 to assist in separating the individual sheets 38. The slot 36 is defined by slits through the wipe and has a shape about corresponding to the shape of the protrusion 30, at least in the widthwise direction. As shown, the slot 36 is rectangular and shares one long side with the division between sheets shown at 34.

Referring to FIG. 11, the slot 36 is caught on the protrusion 30 as the wipe passes over the protrusion as a result of the user pulling on the wipe. Sheets pass over the protrusion until the slot 36 is reached, and at that point the protrusion 30 is received in the slot and hampers withdrawal of the next upstream sheet, assisting in the tearing of the sheet from the upstream sheet. The inclusion of the slots 36 along the roll 32 and the presence of the protrusion 30 on the front cover cooperate to assist in separating a single sheet from the continuous roll, along with the pulling force from the user. When a sheet 38 is torn away, the user opens the front cover, grabs the next sheet in line and pulls, repeating the tear away process. Thus, the dispenser 10 and roll 32 cooperate to provide a single sheet to the user at a time. In an alternative embodiment the tabs 40 extending from the next sheet may have a length sufficient to protrude beyond the front cover, and thus the tabs 40 may be grabbed to advance the roll as opposed to having to open the front cover 14.

The wipe can be dry, but is preferably moist and is coated or impregnated with at least one of a sanitizing, moisturizing, antibacterial or antiviral agent. The wipes can optionally include fragrance.

In specific embodiments, the discharge slot 20 can be tapered and downwardly extending. The housing 10 may be mounted on any surface, such as a wall adjacent a toilet, in the same manner as a conventional toilet paper holder. While the particular dispenser 10 described herein is manually-operated by either pulling a sheet downwardly through the discharge slot 20 or by rotating the mandrel 26 with the finger-graspable features 24, an alternative embodiment envisions the use of an automatic system by which a push-button, motion detector or similar device initiates the dispensing of a single sheet through the discharge slot 20 to be removed for use, thus avoiding or minimizing contact between the user and the dispenser.

The foregoing is a description of roll form toilet wipes and associated dispenser given by way of example only. Although the invention has been described with reference to preferred embodiments thereof, other embodiments may perform similar functions and/or achieve similar results. Any and all such equivalent embodiments and examples are within the spirit and scope of the present invention and are intended to be covered by the appended claims.

What is claimed is:

1. A toilet wipes dispenser, comprising:

(a) a housing defining an interior cavity for receiving roll form toilet wipes therein, one open side, one closed side opposite the open side, and an opening about a front of the housing;

(b) a side panel configured to be removably received within the open side of the housing, the side panel carrying a single mandrel upon which the roll form toilet wipes are rotatably carried, the single mandrel extending the axial length of the interior cavity of the housing; and (c) a front cover connected to the housing adjacent the opening about the front of the housing, the front cover and the opening about the front of the housing cooperatively defining a discharge slot for pulling sheets of the roll form toilet wipes from the toilet wipes dispenser, the front cover configured to pivot open, the front cover having a protrusion positioned completely within the toilet wipes dispenser and extending into the discharge slot such that the protrusion engages the roll form toilet wipes to separate the wipes into individual sheets as the wipes are pulled from the toilet wipes dispenser.

2. The toilet wipes dispenser according to claim 1, wherein the side panel is disc-shaped and rotatable relative to the housing, wherein the side panel includes at least two protruding chords that are perpendicular to each other and bifurcate the disc shaped side panel on a face of the side panel opposite the mandrel such that the at least two protruding chords form a graspable feature.

3. The toilet wipes dispenser according to claim 1, wherein the front cover further comprises an indentation that forms a graspable feature on an outer surface of the front cover, the outer surface of the front cover is opposite the protrusion completely positioned within the toilet wipes dispenser and the indentation directly corresponds to the protrusion completely positioned within the toilet wipes dispenser.

4. The toilet wipes dispenser according to claim 3, further comprising:

(d) roll form toilet wipes rotatably carried on the mandrel, the roll form toilet wipes comprising a continuous roll of wipe divided into sheets by perforations through the width of the wipe, the wipe further defining a slot adjacent each division between sheets, the slot configured to align with the protrusion of the front cover such that the protrusion is configured to protrude through the slot to assist in separating sheets as the wipe is withdrawn through the discharge slot.

5. The toilet wipes dispenser according to claim 4, wherein the slot adjacent each division between sheets shares one side with its respective division between sheets.

6. The toilet wipes dispenser according to claim 1, wherein the housing further defines a rearwardly extending portion clear of a roll form toilet wipe carrying portion for mounting the dispenser to a supporting surface.

7. The toilet wipes dispenser according to claim 1, wherein the front cover is connected to the housing by a hinge along one side of the front cover such that the front cover can be opened to access the interior cavity without being separated from the housing.

8. The toilet wipes dispenser according to claim 7, wherein the hinge is a living hinge.

9. The toilet wipes dispenser according to claim 1, wherein the protrusion protrudes through the discharge slot.

10. A toilet wipes dispenser, comprising:

(a) a housing defining an interior cavity having an axial length for receiving roll form toilet wipes therein, one open side, one permanently closed side opposite of the one open side, and an opening about a front of the housing;

(b) a side panel configured to be removably received within the open side of the housing, the side panel carrying a single mandrel; the single mandrel extending substantially the entire axial length of the interior cavity of the housing;

(c) a front cover connected to the housing adjacent the opening about the front of the housing, the front cover and the opening about the front of the housing cooperatively defining a discharge slot for sheets of the roll form toilet wipes from the toilet wipes dispenser, the front cover configured to pivot open, the front cover having a protrusion positioned completely within the toilet wipes dispenser and extending in a direction of the housing and protruding into the discharge slot such that the protrusion is configured to engage the toilet wipes, and (d) roll form toilet wipes rotatably carried on the mandrel, the roll form toilet wipes comprising a continuous roll of wipe divided into sheets by perforations through the width of the wipe, the wipe further defining a slot adjacent each division between sheets through which the protrusion of the front cover protrudes to assist in separating sheets as the wipe is withdrawn through the discharge slot.

11. The toilet wipes dispenser according to claim 10, wherein the side panel is disc-shaped and rotatable relative to the housing, wherein the side panel includes at least two protruding chords that are perpendicular to each other and bifurcate the disc shaped side panel on a face of the side panel opposite the mandrel such that the at least two protruding chords form a graspable feature.

12. The toilet wipes dispenser according to claim 10, wherein the front cover further comprises an indentation that forms a graspable feature on an outer surface of the front cover, the outer surface of the front cover is opposite the protrusion completely positioned within the toilet wipes dispenser and the indentation directly corresponds to the protrusion completely positioned within the toilet wipes dispenser.

13. The toilet wipes dispenser according to claim 10, wherein the housing further defines a rearwardly extending portion clear of the roll form toilet wipes for mounting the dispenser to a supporting surface.

14. The toilet wipes dispenser according to claim 10, wherein the front cover is connected to the housing by a hinge along one side of the front cover such that the front cover can open to provide access to the interior cavity without being separated from the housing.

15. The toilet wipes dispenser according to claim 14, wherein the hinge is a living hinge.

16. The toilet wipes dispenser according to claim 10, wherein the protrusion protrudes through the discharge slot.

17. The toilet wipes dispenser according to claim 10, wherein the slot adjacent each division between sheets shares one side with its respective division between sheets.

* * * * *